US009265314B2

(12) United States Patent
Chen et al.

(10) Patent No.: US 9,265,314 B2
(45) Date of Patent: Feb. 23, 2016

(54) FULL AUTOMATIC OPENING AND CLOSING STRAIGHT BONE UMBRELLA

(71) Applicant: XIAMEN MINGHO BROTHERS MFG CO., LTD, Xiamen (CN)

(72) Inventors: Tien-Cheng Chen, Xiamen (CN); Sun-Feng Sung, Xiamen (CN)

(73) Assignee: XIAMEN MINGHO BROTHERS MFG CO., LTD., Xiamen, Fujian (CN)

( * ) Notice: Subject to any disclaimer, the term of this patent is extended or adjusted under 35 U.S.C. 154(b) by 0 days.

(21) Appl. No.: 14/398,466

(22) PCT Filed: Mar. 8, 2013

(86) PCT No.: PCT/CN2013/072334

§ 371 (c)(1),
(2) Date: Nov. 2, 2014

(87) PCT Pub. No.: WO2014/134818

PCT Pub. Date: Sep. 12, 2014

(65) Prior Publication Data

US 2015/0366306 A1 Dec. 24, 2015

(51) Int. Cl.

*A45B 25/14* (2006.01)
*A45B 25/02* (2006.01)
*A45B 25/16* (2006.01)

(52) U.S. Cl.

CPC ..... *A45B 25/143* (2013.01); *A45B 25/02* (2013.01); *A45B 25/165* (2013.01)

(58) Field of Classification Search

CPC ..... A45B 25/143; A45B 25/02; A45B 25/14; A45B 25/165
USPC ..... 135/20.3
See application file for complete search history.

(56) References Cited

U.S. PATENT DOCUMENTS

| | | | | |
|---|---|---|---|---|
| 5,291,908 | A * | 3/1994 | Grady, II | A45B 25/165 135/20.3 |
| 6,543,464 | B1 * | 4/2003 | Grady, II | A45B 25/14 135/20.3 |
| 7,562,666 | B2 * | 7/2009 | Chan | A45B 25/143 135/16 |
| 7,909,049 | B2 * | 3/2011 | Yang | A45B 19/04 135/20.3 |
| 8,757,183 | B2 * | 6/2014 | Volin | A45B 25/143 135/20.3 |
| 8,857,453 | B2 * | 10/2014 | Souma | A45B 25/143 135/20.3 |
| 2004/0040591 | A1 * | 3/2004 | Ma | A45B 25/143 135/98 |
| 2005/0166950 | A1 * | 8/2005 | Grady, II | A45B 25/143 135/75 |
| 2006/0151019 | A1 * | 7/2006 | Lo | A45B 25/165 135/20.3 |

FOREIGN PATENT DOCUMENTS

| | | | | |
|---|---|---|---|---|
| WO | WO 2011155788 A2 * | 12/2011 | ..... | A45B 25/143 |

* cited by examiner

*Primary Examiner* — Noah Chandler Hawk

(57) ABSTRACT

A full automatic opening and closing straight bone umbrella includes a middle bar set and an opening and closing umbrella drive mechanism in the middle bar set, an umbrella frame, an umbrella cloth, an upper nest, a middle nest, an umbrella handle, and a power source in the umbrella handle. The opening and closing umbrella drive mechanism includes a lead screw connected to the power source and an ejector sleeve driven by the lead screw. The middle bar set includes a middle pipe and an outer pipe. The ejector sleeve passes through the middle pipe and is connected to the outer pipe. When the power source is operated to drive the lead screw to turn clockwise or counterclockwise, the ejector sleeve brings the outer pipe to move up or down relative to the middle pipe to provide a full automatic opening and closing function to the umbrella.

9 Claims, 4 Drawing Sheets

FULL AUTOMATIC OPENING AND CLOSING STRAIGHT BONE UMBRELLA

BACKGROUND OF THE INVENTION

1. Field of the Invention

The present invention relates to a full automatic opening and closing straight bone umbrella which can be controlled to open/close automatically.

2. Description of the Prior Art

In these days, the climate is constantly changing so people are used to take an umbrella along to prevent a heavy rain unexpectedly. But, the frame of a conventional umbrella has to be pushed to a specific position to open the umbrella. Once there is a sudden downpour, the user may be wet because he/she cannot open the umbrella quickly. Therefore, an improved umbrella is developed. The umbrella handle is provided with a button. The user just presses the button to open the umbrella automatically. But, this kind of umbrella doesn't have the function to close the umbrella automatically. When the user gets in the car, he/she has to close the umbrella with both hands. In such a short time, the user is always wet. This umbrella is inconvenient for use.

Most straight umbrellas have an automatic opening and closing function. When the lower nest is not held, the umbrella can be folded. This kind of straight umbrella cannot be unfolded automatically. Chinese Utility Model Publication No. CN2523255Y discloses an automatic opening and closing straight umbrella, published on Dec. 4, 2002. The umbrella comprises a frame with a spring, a ratio changing mechanism disposed in a middle bar set, and a handle control device. The structure of the ratio changing mechanism is complicated. It needs a buckle connected with a pull rope to unlock and lock the handle control device so as to carry out the automatic opening and closing function. After the umbrella is folded, it needs to apply a force to lock the buckle and the handle control device in position in order to carry out the automatic opening and closing function next time.

This automatic opening and closing straight umbrella has a complicated structure and the manufacturing cost is high. It doesn't provide a full automatic opening and closing function. Accordingly, the inventor of the present invention has devoted himself based on his many years of practical experiences to solve these problems.

SUMMARY OF THE INVENTION

The primary object of the present invention is to provide a full automatic opening and closing straight bone umbrella to open/close the umbrella automatically.

In order to achieve the aforesaid object, the full automatic opening and closing straight bone umbrella comprises a middle bar set, an umbrella frame, an umbrella cloth secured on the umbrella frame, an upper nest fixed at the top end of the middle bar set, a middle nest fitted on the middle bar set, and an umbrella handle. The umbrella frame cooperates with the upper nest and the middle nest. The full automatic opening and closing straight bone umbrella further comprises an opening and closing umbrella drive mechanism and a power source disposed in the umbrella handle. The opening and closing umbrella drive mechanism comprises a lead screw and an ejector sleeve driven by the lead screw to move up or down. The lower end of the lead screw is connected to the power source in the umbrella handle. The middle bar set comprises a middle pipe having two ends respectively connected to the umbrella handle and the upper nest and a movable outer pipe fitted on the middle pipe. The ejector sleeve passes through the middle pipe and is connected to the outer pipe. The side wall of the middle pipe is formed with a groove for the ejector sleeve to move up or down. The upper portion of the outer pipe is provided with a position limiting structure to bring the middle nest to move up. A control button is provided on the umbrella handle to start the power source to turn clockwise or counterclockwise.

Preferably, the umbrella frame comprises a plurality of main ribs and short ribs. One end of each main rib is pivotally connected to the upper nest, and another end of each main rib is a free end. One end of each short rib is pivotally connected to the middle nest, and another end of each short rib is pivotally connected to a corresponding one of the main ribs.

Preferably, the full automatic opening and closing straight bone umbrella further comprises a lower nest fitted on the outer pipe. The umbrella frame comprises a plurality of main ribs, short ribs, and long ribs. One end of each main rib is pivotally connected to the upper nest, and another end of each main rib is a free end. One end of each short rib is pivotally connected to the middle nest, and another end of each short rib is pivotally connected to a corresponding one of the main ribs. One end of each long rib is pivotally connected to the lower nest, and another end of each long rib is pivotally connected to a corresponding one of the main ribs. A spring is provided between the lower nest and each main rib.

Preferably, the position limiting structure of the outer pipe is a flange formed on the outer pipe or one of a sleeve ring and a pin provided on the outer pipe.

Preferably, the upper end of the outer pipe is provided with a retaining structure for the middle nest.

Preferably, the inner wall of the ejector sleeve is formed with threads to mate with the lead screw.

Preferably, a nut is provided in the ejector sleeve to mate with the lead screw, and the nut is disposed at the lower portion of the ejector sleeve.

Preferably, the lower portion of the outer pipe is provided with a push sleeve to cover the lower end of the outer pipe.

Preferably, a buffer pad is provided between the lower nest and the middle nest.

Preferably, the power source is a mechanical drive composed of a change gear set or a motor drive to turn clockwise or counterclockwise.

The middle bar set of the full automatic opening and closing straight bone umbrella of the present invention is composed of the outer pipe and the middle pipe. The opening and closing umbrella drive mechanism is provided in the middle pipe to bring the outer pipe to move up or down relative to the middle pipe. The opening and closing umbrella drive mechanism is connected with the power source in the umbrella handle. When the opening and closing umbrella drive mechanism brings the outer pipe to move up relative to the middle pipe, the middle nest is to push the umbrella frame to open the umbrella. On the contrary, when the opening and closing umbrella drive mechanism brings the outer pipe to move down relative to the middle pipe, the middle nest is released and the umbrella frame subject to the umbrella cloth is folded toward the center to close the umbrella. The umbrella provides a full automatic opening closing function for people to use the umbrella conveniently and quickly. Compared to the existing umbrellas, the present invention has a simple structure.

DETAILED DESCRIPTION OF THE PREFERRED EMBODIMENTS

Figure 1:
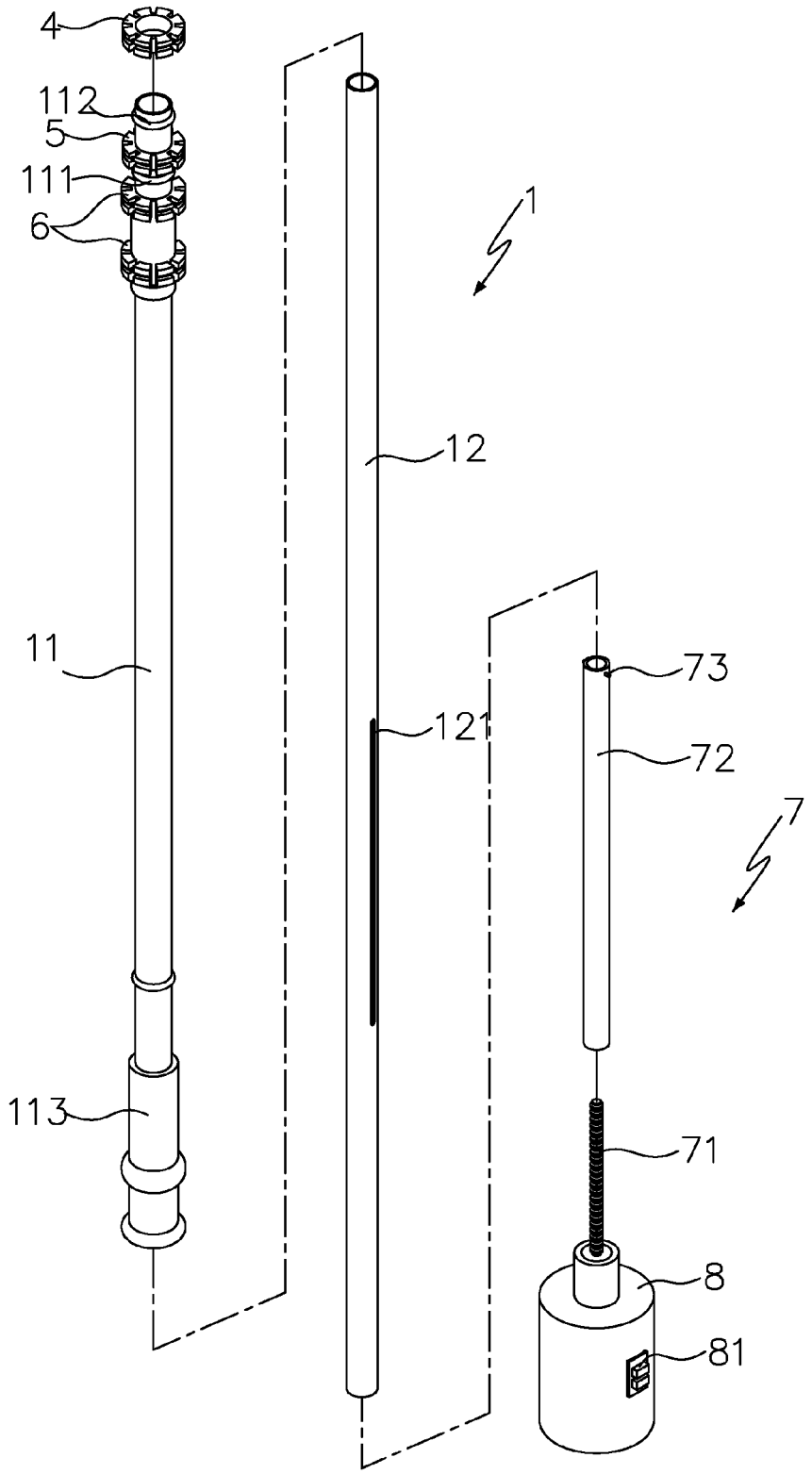
FIG. 1 is an exploded view according to a preferred embodiment of the present invention.

Embodiments of the present invention will now be described, by way of example only, with reference to the accompanying drawings.

As shown in FIG. 1 to FIG. 4 the present invention discloses a full automatic opening and closing straight bone umbrella. In the embodiment, the full automatic opening and closing straight bone umbrella comprises a middle bar set 1, an umbrella frame 2, an umbrella cloth 3 secured on the umbrella frame 2, an upper nest 4, a middle nest 5, a lower nest 6, an opening and closing umbrella drive mechanism 7, and an umbrella handle 8.

The umbrella frame 2 comprises a plurality of main ribs 21, short ribs 22, and long ribs 23. One end of each main rib 21 is pivotally connected to the upper nest 4, and another end of each main rib 21 is a free end. One end of each short rib 22 is pivotally connected to the middle nest 5, and another end of each short rib 22 is pivotally connected to a corresponding one of the main ribs 21. One end of each long rib 23 is pivotally connected to the lower nest 6, and another end of each long rib 23 is pivotally connected to a corresponding one of the main ribs 21. A spring 24 is provided between the lower nest 6 and each main rib 21.

Referring to FIG. 1, the middle bar set 1 comprises an outer pipe 11 and a middle pipe 12 having a length greater than that of the outer pipe 11. The lower end of the middle pipe 12 is fixed on the umbrella handle 8. The upper end of the middle pipe 12 cooperates with the upper nest 4. The outer pipe 11 is movably fitted on the middle pipe 12. The middle nest 5 and the lower nest 6 are movably fitted on the outer pipe 11. The upper portion of the outer pipe 11 is provided with a position limiting structure 111 for the middle nest 5 to move above the position limiting structure 111. The position limiting structure 111 can be a flange formed on the outer pipe 11, alternatively, it can be a sleeve ring or a pin provided on the outer pipe 11. In order to prevent the middle nest 5 from disengaging from the outer pipe 11, the upper end of the outer pipe 11 is provided with a retaining structure 112 after the middle nest 5 is mounted on the outer pipe 11. The structure of the retaining structure 112 is identical to the position limiting structure 111.

The opening and closing umbrella drive mechanism 7 comprises a lead screw 71 and an ejector sleeve 72 disposed on the lead screw 71. The lower end of the lead screw 71 is connected to the power source in the umbrella handle 8. A nut 721 is provided in the ejector sleeve 72 to mate with the lead screw 71. When the power source is operated to drive the lead screw 71 to turn clockwise or counterclockwise, the ejector sleeve 72 is brought to move up or down relative to the lead screw 71. In this embodiment, the nut 721 is disposed at the lower portion of the ejector sleeve 72. The ejector sleeve 72 is inserted in the middle pipe 12. A connecting member 73 of the ejector sleeve 72 passes through the side wall of the middle pipe 12 and is connected to the outer pipe 11. The side wall of the middle pipe 12 is formed with a lengthwise groove 121 for the connecting member 73 to move up or down.

Alternatively, there is no need to provide the nut 721 in the ejector sleeve 72. The inner wall of the ejector sleeve 72 is formed with threads to mate with the lead screw 71, such that the lead screw 71 brings the ejector sleeve 72 to move up or down.

The route for the nut 721 to move up or down along the lead screw 71 is also the route for the middle nest 5 to move up or down relative to the middle pipe 12.

The umbrella handle 8 is a casing to accommodate the power source. A control button 81 is provided on the umbrella handle 8 to start the power source to turn clockwise or counterclockwise. The power source can be a mechanical drive composed of a change gear set or a motor drive to turn clockwise or counterclockwise.

Figure 2:
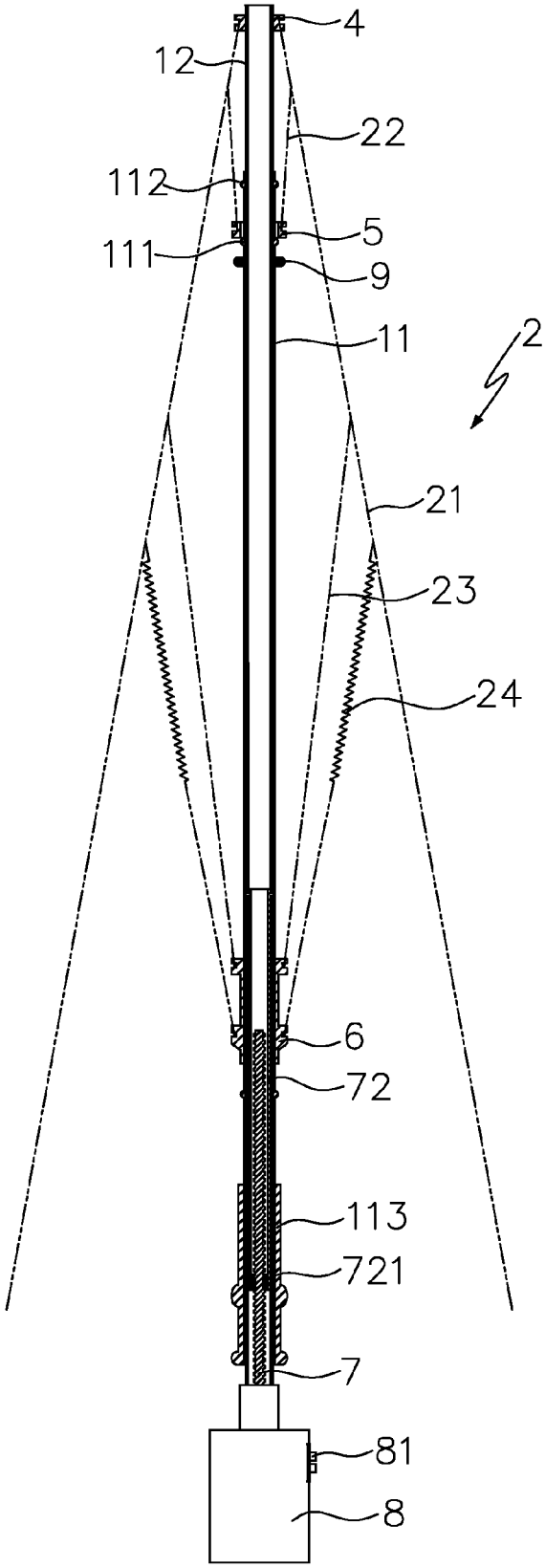
FIG. 2 is a schematic view showing the umbrella of the present invention in a closed state.

Referring to FIG. 2, the umbrella of the present invention is in a closed state. The nut 721 is located at the lower portion of the lead screw 71, namely, the ejector sleeve 72 is located at the lower portion relative to the middle pipe 12.

Figure 3:
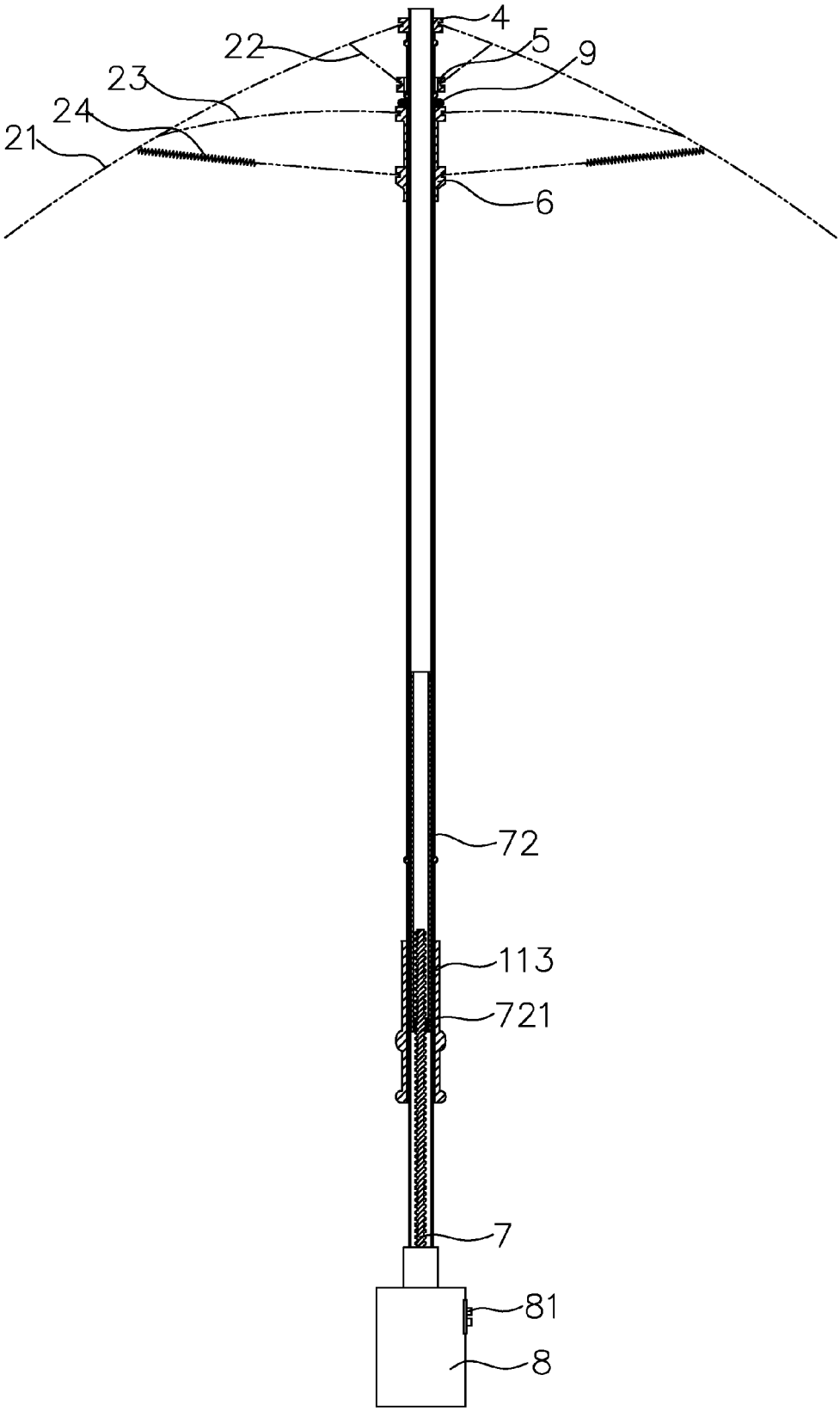
FIG. 3 is a sectional view showing the umbrella of the present invention in an open state.
Figure 4:
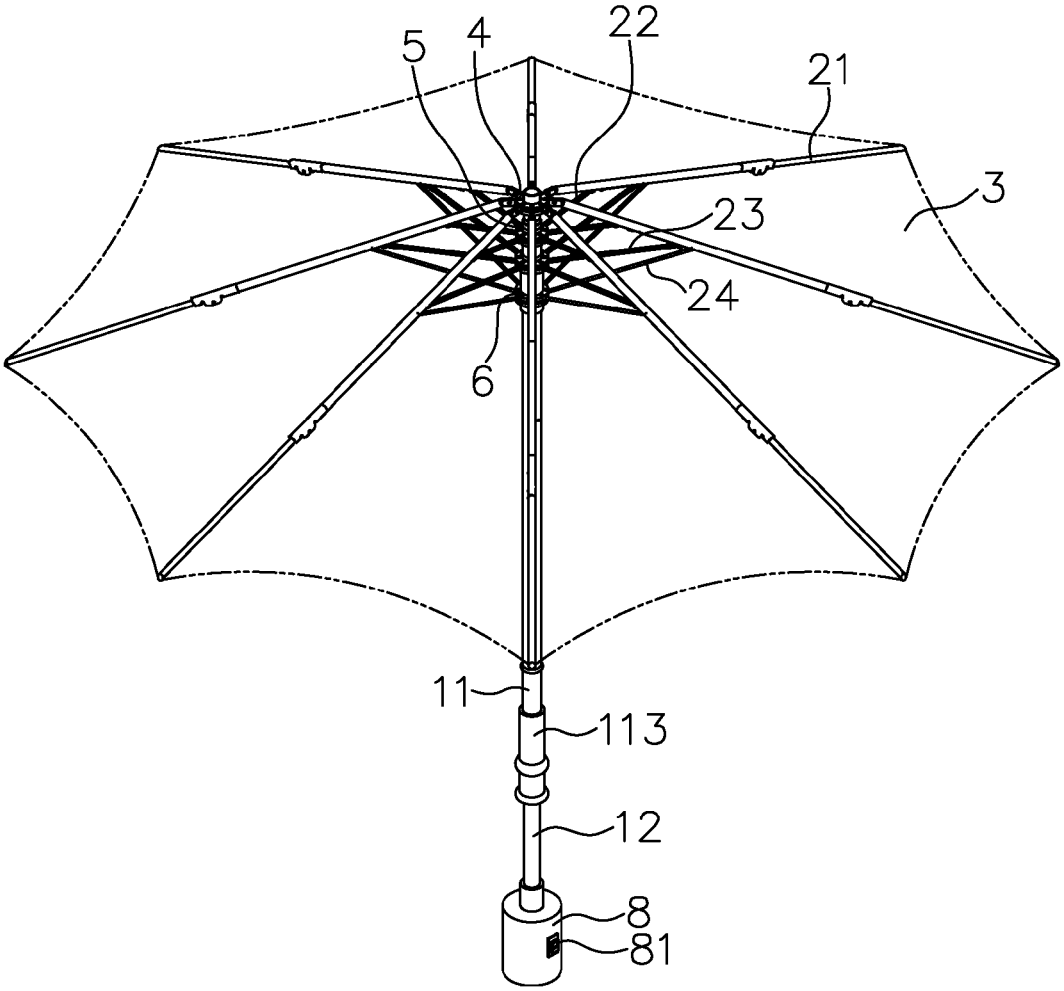
FIG. 4 is a schematic view showing the umbrella of the present invention in an open state.

Referring to FIG. 3 and FIG. 4, when the user wants to open the umbrella, the control button 81 of the umbrella handle 8 is pressed to start the power source to output a clockwise turning force. The power source will bring the lead screw 71 to turn, so that the nut 721 is moved up relative to the lead screw 71. At the same time, the ejector sleeve 72 is moved up relative to the lead screw 71, and the ejector sleeve 72 brings the outer pipe 11 to move up relative to the middle pipe 12. When the outer pipe 11 is moved up, the position limiting structure 111 at the upper portion of the outer pipe 11 will push the middle nest 5 to move up synchronously, with the short ribs 22 to push away the main ribs 21 so as to open the umbrella. When the main ribs 21 are unfolded, the long ribs 23 are brought to unfold simultaneously and the lower nest 6 is brought to move toward the upper portion of the outer pipe 11 until the umbrella is opened fully. The main ribs 21 of the umbrella frame 2 rely on the middle nest 5 to bring the short ribs 22 to apply a force so as to open the umbrella. After the umbrella is unfolded, the springs 24 hold against the main ribs 21, the umbrella frame 2 subject to the umbrella cloth 3 makes the long ribs 23 unfold at an angle, and the lower nest 6 is unable to move down.

For the entire appearance of the middle bar set 1, the lower portion of the outer pipe 11 is provided with a push sleeve 113 to cover the lower end of the outer pipe 11. In addition, a buffer pad 9 is provided at the position where the lower nest 6 is brought to slide up to the middle nest 5, preventing an excessive impact.

Referring to FIG. 3 and FIG. 2, when the user wants to close the umbrella, the control button 81 of the umbrella handle 8 is pressed to start the power source to output a counterclockwise turning force. The power source will bring the lead screw 71 to turn reversely, so that the nut 721 is moved down relative to the lead screw 71. At the same time, the ejector sleeve 72 is moved down relative to the lead screw 71, and the ejector sleeve 72 brings the outer pipe 11 to move down relative to the middle pipe 12. When the outer pipe 11 is moved down, the position limiting structure 111 at the upper portion of the outer pipe 11 will release the middle nest 5. The umbrella frame 2 subject to the umbrella cloth 3 is folded toward the middle bar set 1, namely, the middle nest 5 along with the outer pipe 11 is moved down relative to the middle pipe 12. The long ribs 23 are not drawn by the main ribs 21, so that the lower nest 6 is moved down along the outer pipe 11 until the umbrella is closed fully. Through the pull function of the springs 24, the umbrella won't loosen automatically.

To sum up, the middle bar set 1 of the full automatic opening and closing straight bone umbrella of the present invention is composed of the outer pipe 11 and the middle pipe 12. The opening and closing umbrella drive mechanism 7 is provided in the middle pipe 12 to bring the outer pipe 11 to move up or down relative to the middle pipe 12. The opening and closing umbrella drive mechanism 7 is connected with the power source in the umbrella handle 8. When the opening and closing umbrella drive mechanism 7 brings the outer pipe 11 to move up relative to the middle pipe 12, the middle nest 5 is to push the umbrella frame to open the umbrella. On the contrary, when the opening and closing umbrella drive mechanism 7 brings the outer pipe 11 to move down relative to the middle pipe 12, the middle nest 5 is released and the umbrella frame subject to the umbrella cloth 3 is folded toward the center to close the umbrella. The umbrella provides a full automatic opening and closing function for people to use the umbrella conveniently and quickly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A full automatic opening and closing straight bone umbrella, comprising a middle bar set, an umbrella frame, an umbrella cloth secured on the umbrella frame, an upper nest fixed at a top end of the middle bar set, a middle nest fitted on the middle bar set, and an umbrella handle; the umbrella frame cooperating with the upper nest and the middle nest; characterized by: the full automatic opening and closing straight bone umbrella comprising an opening and closing umbrella drive mechanism and a power source disposed in the umbrella handle; the opening and closing umbrella drive mechanism comprising a lead screw and an ejector sleeve driven by the lead screw to move up or down, a lower end of the lead screw being connected to the power source in the umbrella handle; the middle bar set comprising a middle pipe having two ends respectively connected to the umbrella handle and the upper nest and a movable outer pipe fitted on the middle pipe; the ejector sleeve passing through the middle pipe and connected to the outer pipe, a side wall of the middle pipe being formed with a groove for the ejector sleeve to move up or down; an upper portion of the outer pipe being provided with a position limiting structure to bring the middle nest to move up; a control button being provided on the umbrella handle to start the power source to turn clockwise or counterclockwise, wherein the fully automatic opening and closing straight bone umbrella further comprising a lower nest fitted on the outer pipe, the umbrella frame comprising a plurality of main ribs, short ribs, and long ribs; one end of each main rib being pivotally connected to the upper nest, another end of each main rib being a free end; one end of each short rib being pivotally connected to the middle nest, another end of each short rib being pivotally connected to a corresponding one of the main ribs; one end of each long rib being pivotally connected to the lower nest, another end of each long rib being pivotally connected to a corresponding one of the main ribs; a spring being provided between the lower nest and each main rib.

2. The full automatic opening and closing straight bone umbrella as claimed in claim 1, wherein the umbrella frame comprises a plurality of main ribs and short ribs; one end of each main rib is pivotally connected to the upper nest and another end of each main rib is a free end; one end of each short rib is pivotally connected to the middle nest, and another end of each short rib is pivotally connected to a corresponding one of the main ribs.

3. The full automatic opening and closing straight bone umbrella as claimed in claim 1, wherein the position limiting structure of the outer pipe is a flange formed on the outer pipe or one of a sleeve ring and a pin provided on the outer pipe.

4. The full automatic opening and closing straight bone umbrella as claimed in claim 1 or 3, wherein an upper end of the outer pipe is provided with a retaining structure for the middle nest.

5. The full automatic opening and closing straight bone umbrella as claimed in claim 1, wherein an inner wall of the ejector sleeve is formed with threads to mate with the lead screw.

6. The full automatic opening and closing straight bone umbrella as claimed in claim 1, wherein a nut is provided in the ejector sleeve to mate with the lead screw, and the nut is disposed at a lower portion of the ejector sleeve.

7. The full automatic opening and closing straight bone umbrella as claimed in claim 1, wherein a lower portion of the outer pipe is provided with a push sleeve to cover a lower end of the outer pipe.

8. The full automatic opening and closing straight bone umbrella as claimed in claim 1, wherein a buffer pad is provided between the lower nest and the middle nest.

9. The full automatic opening and closing straight bone umbrella as claimed in claim 1, wherein the power source is a mechanical drive composed of a change gear set or a motor drive to turn clockwise or counterclockwise.

* * * * *